United States Patent [19]

Benedict

[11] 4,137,821

[45] Feb. 6, 1979

[54] ARTICLE HANDLING BELT

[75] Inventor: Charles E. Benedict, Tallahassee, Fla.

[73] Assignee: Tesseract Corporation, Tallahasee, Fla.

[21] Appl. No.: 801,263

[22] Filed: May 27, 1977

[51] Int. Cl.[2] ..... F42B 39/08

[52] U.S. Cl. ..... 89/35 R; 198/656

[58] Field of Search ..... 89/35 R, 35 A, 33 MC; 198/655, 656; 221/77, 84

[56] References Cited

U.S. PATENT DOCUMENTS

| | | | |
|---|---|---|---|
| 735,757 | 8/1903 | Grubbs | 89/35 R |
| 1,346,207 | 7/1920 | Jennings | 89/35 R |
| 1,424,751 | 8/1922 | Bangerter | 89/33 MC |
| 2,337,657 | 12/1943 | Hendley | 89/35 R |
| 2,391,081 | 12/1945 | Von Hofe et al. | 89/35 R |
| 2,823,789 | 2/1958 | Henning | 89/35 R |
| 2,856,819 | 10/1958 | Meyers et al. | 89/1.804 |
| 3,253,512 | 5/1966 | Schallen | 89/35 A |
| 3,348,658 | 10/1967 | Cannon | 198/645 |
| 3,429,220 | 2/1969 | Goode | 89/35 R |
| 3,706,260 | 12/1972 | Rausing | 89/35 R |
| 3,759,137 | 9/1973 | Grandy | 89/35 R |

FOREIGN PATENT DOCUMENTS

| | | | |
|---|---|---|---|
| 513452 | 8/1952 | Belgium | 89/35 R |

*Primary Examiner*—Stephen C. Bentley
*Attorney, Agent, or Firm*—Dowell & Dowell

[57] ABSTRACT

A belt apparatus having a multiplicity of tubular sleeves connected together in spaced parallel relationship, which serve as containers for slender elongated articles such as ammunition and the like. The sleeves are connected together by a plurality of flexible webs in a manner to maintain a constant pitch or distance between longitudinal axes of the sleeves while moving in a straight line as well as moving in an arcuate path.

4 Claims, 19 Drawing Figures

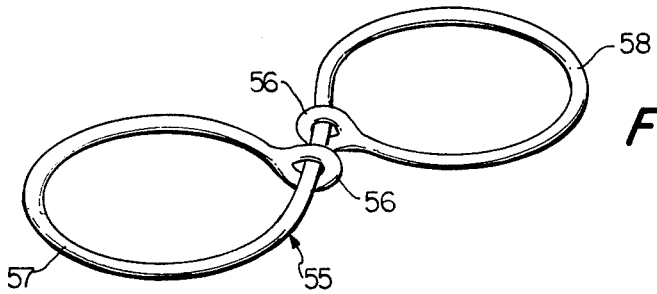
FIG. 15
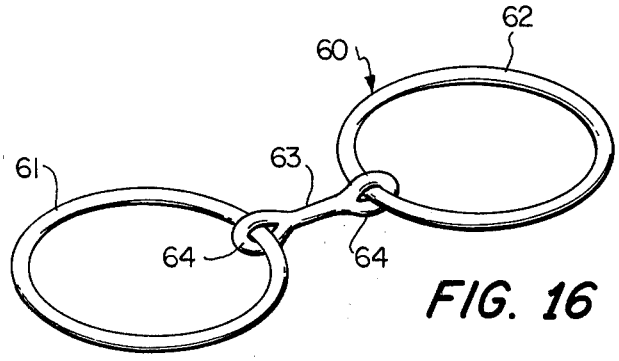
FIG. 16
FIG. 17
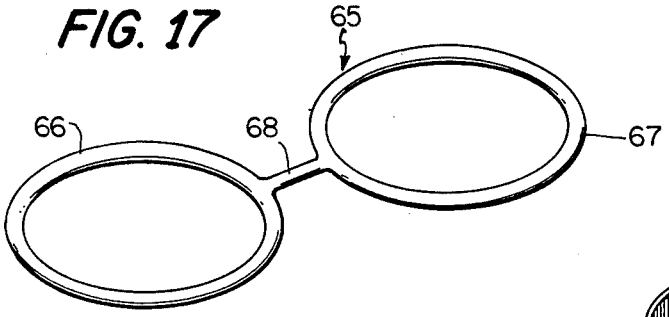
FIG. 18
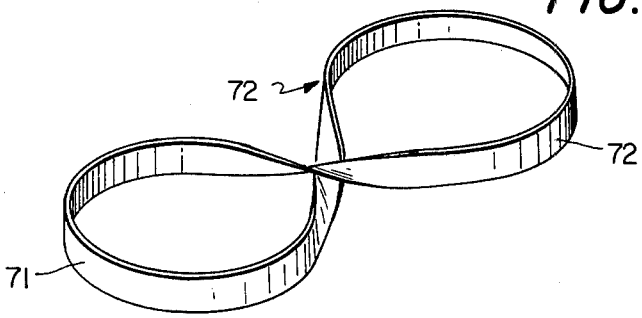
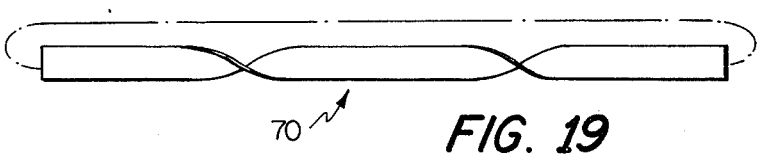
FIG. 19

ARTICLE HANDLING BELT

BACKGROUND OF THE INVENTION

1. Field of the Invention.

This invention relates generally to apparatus for handling articles of various kinds and relates particularly to a conveyor belt having a plurality of elongated tubular containers connected together in spaced generally parallel relationship for transfering the articles from one location to another.

2. Description of the Prior Art.

Heretofore many efforts have been made to provide conveyor belts for articles of various kinds, including elongated generally cylinderical articles such as ammunition used with automatic weapons. However, most of these prior art structures have included cloth belts which frictionally engaged the articles such as ammunition in a manner that the belt was fed through the chamber of a weapon where the projectile was fired, while the shell portion of the ammunition remained on the belt. Some examples of this type of structure are the U.S. Patents to Grubbs No. 735,757; Jennings No. 1,346,207; Hendley No. 2,337,657; Bonhofe et al No. 2,391,081; Goode No. 429,220; Rousing No. 3,706,260; and Grandy No. 3,759,137.

Normally relatively large cartridges of ammunication, such as 20 mm to 40 mm shells, are transported from a manufacturer to an ammunition depot in ammunition boxes and each of the shells is independently stored within a disposable protective wrapper constructed of heavy duty cardboard, pressed paper, or thermoplastic material. At the ammunition depot the shells are manually removed from the disposable wrapper after which the shells are inserted into a cartridge belt or the like and the protective wrappers are discarded.

Discarding the wrappers has resulted in loss and waste of this package material and has created a trash disposal problem. In addition, the use of shells packaged in removable separate wrappers has necessitated a cumbersome and time consuming transfer of the cartridges into a cartridge belt. Also it has been time consuming and difficult to efficiently store and dispose of used shells and misfired cartridges.

Although the invention will be described for use with the handling and storage of ammunition, it is contemplated that the present structure could be used for other article transfer systems which utilize a plurality of connected sleeves or containers that move the articles from one location to another.

SUMMARY OF THE INVENTION

The present invention is embodied in an article handling belt including a plurality of containers connected together in a manner that the longitudinal axes of such containers are in predetermined spaced generally parallel relationship regardless of whether the belt is moving along a planar path or a curvilinear path. In a first embodiment, a pair of first flexible webs are attached to a pair of adjacent containers and partially encircle these adjacent containers in clockwise and counterclockwise directions, respectively, by passing over one container and passing under the adjacent container. At least one second flexible web is attached at its ends to the same pair of containers in spaced relationship to the pair of first webs and partially encircles these containers. The second web extends around the adjacent containers in opposite directions from the pair of first webs to provide a rolling action when moving out of a straight line plane so that the axes of the containers remain spaced a constant distance apart.

In a second embodiment each of the adjacent containers is provided with an annular groove spaced inwardly from each end. A plurality of flexible webs formed substantially in a configuration resembling a figure 8 is provided so that a pair of loops are arranged in side-by-side relationship. One of the loops is placed within a groove of one of the containers after which a second container is slipped into the second loop until the second loop is received within the groove of the second container. Thereafter the first loop of a second web is placed in the groove of the second container and a third container is slipped into the second loop in such a manner that a multiplicity of containers are connected together by a series of individual looped webs. Such looped webs are located in the annular grooves at opposite ends of each of the containers.

The webs in this embodiment may be constructed of cordlike material having a generally circular cross-section, or such webs may be constructed of thin flat tape material. With this construction the webs may be easily placed on the first container since such webs are flexible; however, the webs are of such a length that the second loop is a tolerance fit with the second container so that the second container normally is forced through the second loop. This not only prevents the containers from slipping out of the loops, particularly when one container is moved axially relative to an adjacent container, but also regulates the distance between the axes of adjacent containers. Since the loops are not physically attached to the containers, it is possible to rotate the individual containers within the loops although this normally does not occur due to the frictional contact between the webs and the containers.

It is an object of the invention to provide a belt having a plurality of flexibly interconnected containers arranged in a manner such that the distance between the axes of the containers remains constant when moving in a straight line in the direction of the length of the belt, as well as when the connected containers are moved through a curved path of travel.

Another object of the invention is to provide a series of interconnected containers which form a belt adapted to move smoothly and without jerking from travel along a straight plane to curvilinear movement.

It is a further object of the invention to provide a series of interconnected containers which may be moved axially with respect to each other and with respect to their direction of travel without distorting the direction of movement of adjacent containers.

It is a further object of the invention to provide a series of flexibly interconnected hollow containers for articles such that the hollow containers may be readily received within a storage receptacle to form a package of generally uniform thickness and further that successive lengths of the interconnected containers may be withdrawn from the receptacle without entangling other lengths of the containers.

BRIEF DESCRIPTION OF THE DRAWINGS

FIG. 15 is a perspective view of a double noose connecting web.

FIG. 16 is a perspective view of a connecting web having a pair of flexible rings received within loops at opposite ends of a connecting member.

FIG. 17 is a perspective view of a connecting web having a pair of flexible loops integrally attached to a connecting member.

FIG. 18 is a perspective view of a connecting web of tape material having a double twist.

FIG. 19 is a lay-out of the structure of FIG. 18.

DESCRIPTION OF THE PREFERRED EMBODIMENTS

Figure 1:
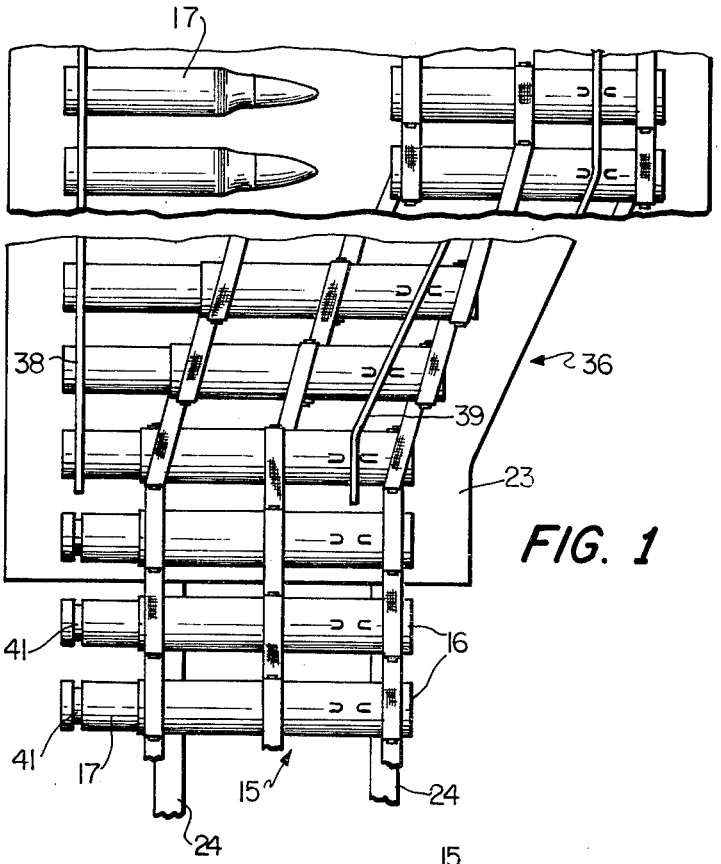
FIG. 1 is a top plan view of an article handling belt according to a first embodiment of the invention in use with a separating apparatus.

With reference to FIGS. 1–11 of the drawings, an article handling conveyor belt 15 is provided which includes a plurality of tubular, elongated generally parallel sleeves or holders 16 connected in spaced generally parallel relationship with the axes of the sleeves positioned normal to the length of the belt. Each sleeve serves as a container for an elongated article 17 such as an ammunition cartridge or the like that may be introduced into and removed lengthwise of the sleeve. Each sleeve 16 is flexibly attached to adjacent sleeves on each side by a plurality of flexible strips or webs 18 and 19. These strips or webs are arranged in alternate rows which extend along the length of the belt and generally normal to the axes of the sleeves.

Figure 4:
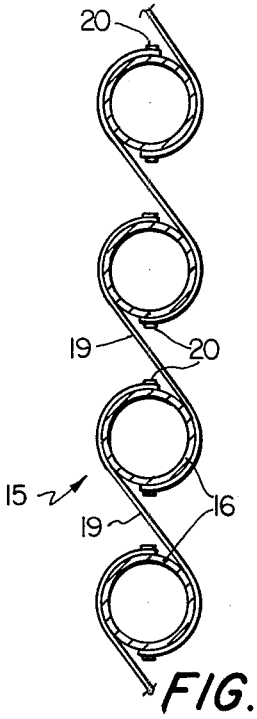
FIG. 4 is a section along line 4—4 of FIG. 2 showing a second row of webs for attaching portions of the belt together.
Figure 2:
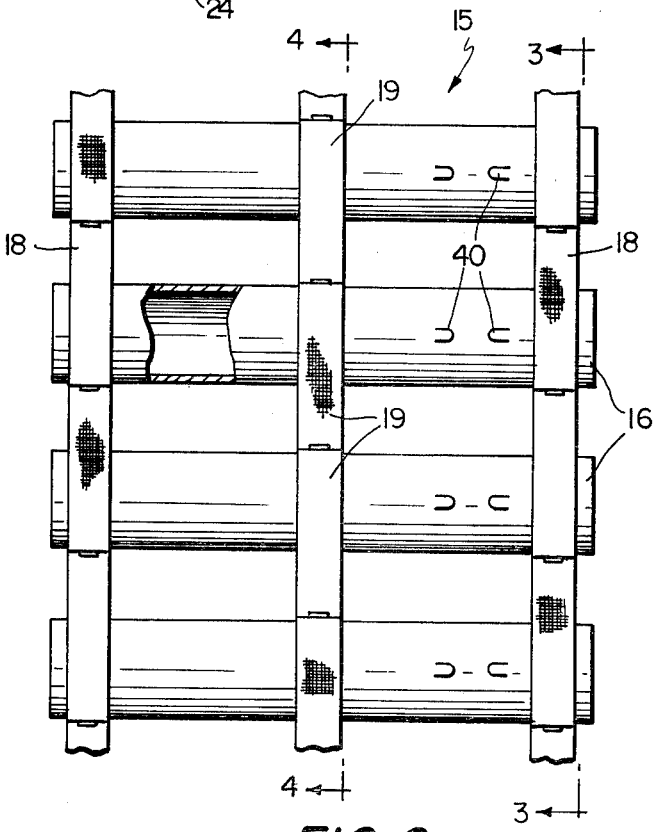
FIG. 2 is an enlarged top plan view of the belt per se.
Figure 3:
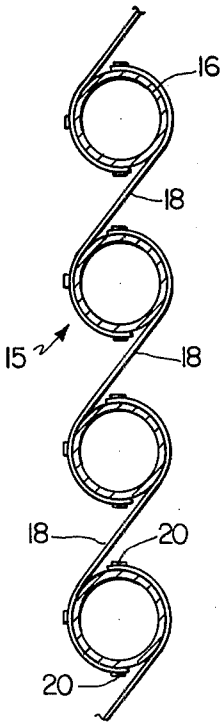
FIG. 3 is a section along line 3—3 of FIG. 2 showing a first row of webs for attaching portions of the belt together.
Figure 5:
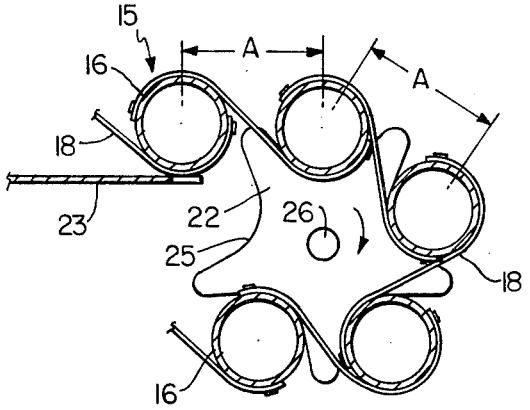
FIG. 5 is a section of the belt in use with a sprocket.

With particular reference to FIGS. 2–4, the sleeves 16 are arranged in spaced generally parallel relationship along a horizontal plane with the axes being spaced apart a predetermined distance. Each sleeve 16 is connected to at least one proximate sleeve by a plurality of flexible strips or webs 18 and 19 which are spaced from each other along the length of the sleeve. Ordinarily the webs 18 and 19 are constructed of substantially non-stretchable material such as nylon webbing or the like, however, in some applications a limited amount of stretching may be permitted or may be desirable.

As shown in FIG. 2, two strips or webs 18 and one strip or web 19 are attached to each sleeve 16 to form three rows of webbing connecting the sleeves together in assembled relationship. The opposite ends of each of the webs 18 and 19 normally are removably attached to the outer wall surface of two adjacent sleeves 16 in any desired manner such as by snap fasteners or pins 20 or the like. The pins 20 are mounted adjacent to each end of the webs 18 and 19 and such pins are snapped into or frictionally received within openings 21 in the sleeves 16. However, such pins do not extend through the inner peripheral wall of the sleeve into interfering relationship with an axially slidable article 17. Since substantially the entire force applied to the pins is a shear force, there is little chance that the pins will be accidentally removed from the openings 21 while in operation.

With particular reference to FIG. 3, the webs 18 are located adjacent to opposite ends of each sleeve and such webs are attached to a pair of contiguous sleeves 16 and form oppositely directed semi-loops which extend transversely of the axes of such sleeves and partially encircle the outer circumferences thereof. Thus, one end of each web 18 is attached to the lefthand side of a first sleeve and partially encircles that sleeve in a clockwise direction. Thereafter, each web 18 extends across to a second sleeve and partially encircles that sleeve in a counterclockwise direction, and the other end is attached to the righthand side of the second sleeve.

With particular reference to FIG. 4, the webs 19 are located in spaced relationship with the webs 18 along the lengths of the sleeves 16 and one end of each web 19 is attached to the lefthand side of the first sleeve and partially encicles the same in a counterclockwise direction. Thereafter, each web 19 extends across to the second sleeve and partially encircles the same in a clockwise direction and the other end is attached to the righthand side of the second sleeve. The arrangement of the webs 18 and 19 is repeated throughout the length of the belt.

It is apparent that the belt may be shortened by removing the pins of certain webs from the cooperating openings in a selected sleeve so that one or more sleeves 16 may be separated from the remainder of the belt. Also the belt may be lengthened by connecting the webs of a first additional sleeve to the last sleeve in the belt. Further it is obvious that if one or more webs or sleeves becomes damaged, such webs or sleeves may be easily removed and replaced without separating or disassembling the entire belt.

The webs 18 and 19 are of equal length and are long enough to permit the sleeves 16 to be spaced a short distance apart. Since the webs are arranged in opposite directions, the rotational forces imparted by the webs 18 are counteracted by the rotational forces imparted by the webs 19 so that proximate sleeves 16 remain spaced apart a fixed distance "A" while travelling along a planar path. The belt 15 may be driven in any desired manner such as by one or more drive sprockets 22 (FIG. 5) and ordinarily, when moving in a horizontal direction, the sleeves 16 are supported by a fixed platform 23 (FIG. 1) or a plurality of support strips 24. It is noted that the drive sprockets 22 are located in a position contiguous to the discharge end of the belt 15 to apply a pulling force to such belt. If desired, one or more intermediate drive or idler sprockets may be positioned along the length of the belt as long as the intermediate sprockets are synchronized with the main drive sprocket.

In order to move the belt 15 along a planar path or to change the direction of movement of the belt 15 out of the horizontal planar path, the drive sprockets 22, and any intermediate drive or idler sprockets, are mounted vertically along the length of the belt and include a plurality of spaced recesses 25 around their outer circumferences. These recesses engage the sleeves 16 at locations spaced from the webs 18 and 19, thereby advancing the belt either in a flat planar path of movement or through a curvilinear path along the pitch circle spaced from the axis of rotation 26 of the sprockets 22. The spacing of the recesses 25 is such that the axes of adjacent sleeves 16 are maintained at the fixed distance "A" as the sleeves travel around the sprockets 22. When the belt 15 passes around the sprockets 22, each sleeve is sequentially moved out of the flat planar path of movement and this permits a rolling motion of a leading sleeve relative to a trailing sleeve on a radius about the axis of the trailing sleeve. This movement is permitted since the rolling action of the leading sleeve takes up the webs 18 and pays out the webs 19 which connect the leading and trailing sleeves together when the movement is in one direction from the horizontal plane and pays out the webs 18 and takes up the webs 19 when the movement is in the other direction from the horizontal plane.

Although the distance "A" between the longitudinal axes of the sleeves 16 remains fixed, the radially outermost portion of the circumference of the leading sleeve is free to move away from a similar point on the trailing sleeve as the leading sleeve moves into a curved path around the drive sprocket from a horizontal planar path. In addition, the radially innermost portion of the leading sleeve is moved closer to a similar portion on the trailing sleeve as the sleeves begin to move along the pitch circle of the drive or idler sprockets 22.

The particular connection between the sleeves 16 described above, enables the sleeves to be maintained at a fixed distance apart and to rotate with respect to each other when the sleeves are moved from one path of travel to another. This relative rotation at a fixed separation distance eliminates any tendency of the belt to jerk the sleeves 16 or other sections of the belt relative to adjacent sleeves or sections as their direction of travel changes.

Although the sleeves 16 have been illustrated and described as being spaced apart by a fixed distance "A", it is contemplated that the distance "A" could be spaced apart farther than shown or could be spaced closer together. As an example, the distance "A" could be equal to the outer diameter of the sleeves plus three thicknesses of the webs 18 or 19 so that such sleeves are in side-by-side relationship and spaced apart only by the thicknesses of the webs. In this configuration, when a leading sleeve moves out of a flat planar plane of a trailing sleeve, the leading sleeve remains substantially in rolling contact with the trailing sleeve. However, the distance "A" between the longitudinal axes of such sleeves remains constant.

Figure 6:
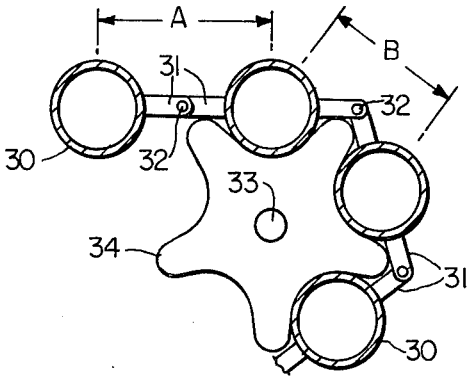
FIG. 6 PRIOR ART
FIG. 6 is a section of a belt according to the prior art in use with a sprocket.
Figure 7:
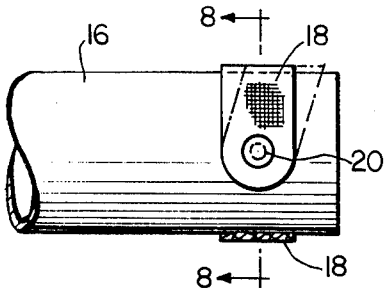
FIG. 7 is an enlarged fragmentary side elevation of a detail of a sleeve illustrating the attachment of a connecting web to a sleeve.

One example of a prior art article handling belt is shown in FIG. 6. In this example, each sleeve 30 is provided with rigid ears 31 extending radially outwardly from diametrically opposed sides and the ears of one sleeve are hingedly connected to the ears of the next adjacent sleeve by means of pins 32. When such hingedly connected sleeves move from a planar path to a circular path around the axis 33 of a sprocket 34, the distance between the axes of the sleeves is decreased from "A" to "B" since the sleeves are rotating about the hinge pins 32 instead of the longitudinal axis of an adjacent sleeve. The distance "B" varies depending upon several factors including the length of the ears and the diameter of the pitch circle of the sprocket. The change in distance between the axes of adjacent sleeves causes uneven movement and tends to jerk the belt as the sleeves move around the sprocket 34.

With particular reference to FIG. 1, the elongated articles 17 such as ammunition cartridges may be removed from the sleeves 16 automatically as the belt 15 is being advanced. This may be done by a separating mechanism 36 including a fixed base or platform 23 to which are attached longitudinally extending cam rails 38 and 39 that extend longitudinally of the length of the belt. A portion of the cam rail 39 diverges laterally from the rail 38. Attached to each sleeve 16 is a pair of radially outwardly extending tabs 40 which are spaced from the rows of webs 18 and 19 and are located so that these tabs 40 engage the cam rail 39 as the belt moves through the separating mechanism.

Each of the cartridges 17 is provided with an annular extraction groove 41 near one end which normally is used for extracting a cartridge casing from the firing chamber of a gun. This grooved end protrudes beyond one open end of a sleeve 16 when the cartridge is located within the sleeve. The rail 38 is positioned to engage the groove 41 in each shell or cartridge 17 so as to hold the cartridge against lateral movement axially along the length of a sleeve as the belt moves through the separating mechanism. During the movement of the belt through the separating mechanism, the tabs 40 on the sleeves 16 engage the divergent rail 39 as the sleeves move through the separating mechanism so that the sleeves are moved axially with respect to the cartridges causing separation of the sleeves from the cartridges while the belt and the cartridges continue to advance in the direction of movement of the belt. The sleeves may be moved axially due to the fact that the webs 18 and 19 are flexible and are rotatably connected to the sleeves by the pins 20.

Figure 11:
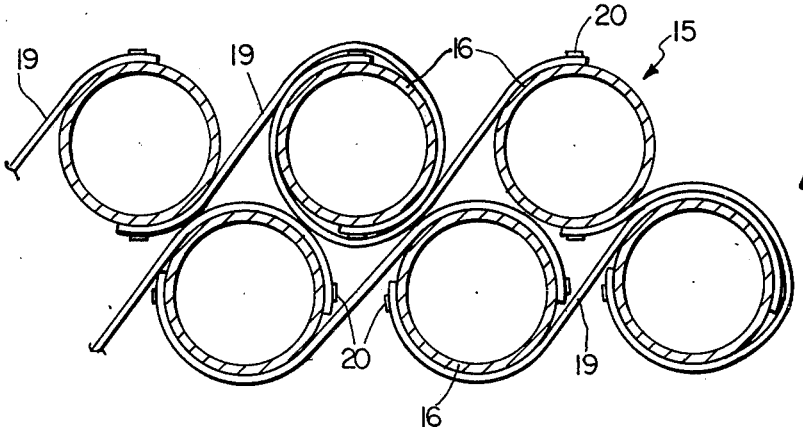
FIG. 11 is a sectional view showing an arrangement for stacking the belt for storage.

As shown best in FIG. 11, the belt 15 may be stacked or arranged in tiers within a container or the like (not shown) in a compact manner. In this arrangement, a first layer of the belt is laid along the bottom of the container with the sleeves 16 being equally spaced and with the webs being attached to each sleeve substantially along the sides of such sleeves. When the first layer reaches the end of the container, the next sleeve is rolled upwardly so that such sleeve is located between and resting on two sleeves of the lower layer. Due to the rolling of the sleeves in the second layer, the webs appear to be attached to each sleeve of the second layer substantially along the top and bottom of each sleeve. However, at the other end of the second layer, when the sleeves are rolled upwardly to form a third layer, the connection of the webs to the sleeves will be substantially the same as the connections in the first layer. This permits the belt to be stored without tangling or uneven buildup of the thickness of the folded belt layers.

Figure 9:
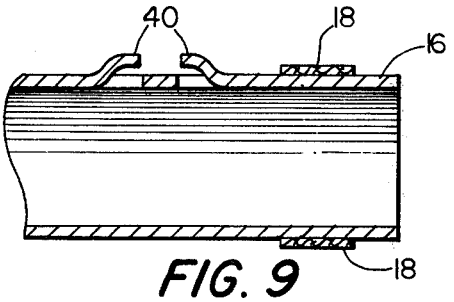
FIG. 9 is an enlarged fragmentary section along the length of a portion of the belt showing cam-engaging means.
Figure 10:
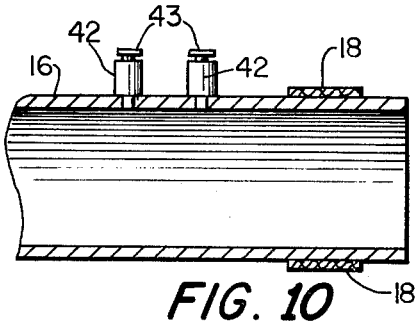
FIG. 10 is a sectional view similar to FIG. 9 and illustrating another embodiment of the cam-engaging means.

FIGS. 9 and 10 show the radially outwardly extending pairs of tabs 40 which engage the cam rail 39 of the separating mechanism 36. In FIG. 9 the upstanding tabs 40 are formed by cutting a pair of opposed tongues from a sleeve and offsetting them upwardly so that the ends of the tabs are generally parallel to and spaced from the outer surface of each sleeve. The ends of the tabs are spaced from each other a distance slightly greater than the thickness of the cam 39.

FIG. 10 shows another embodiment of the upstanding tabs for each sleeve wherein a pair of cylinders 42 are rotatably mounted on headed posts or pins 43 and such posts are riveted or otherwise attached to each sleeve in a position to engage the cam 39. Although each post is mounted on the wall of a sleeve, the inner end of the post does not extend radially inwardly of the wall and thus into interfering relationship with the elongated article or cartridge 17 which slides axially into and out of a sleeve.

It is noted that the pair of cam-engaging tabs 40 or posts 43 are spaced along the length of each sleeve 16 and located in spaced relationship with the webs 18 and 19 attached to each of the sleeves. In addition, these tabs or posts are located so as not to interfere with the operation of the sleeve engaging drive sprocket or idlers 21.

With reference to FIGS. 12–19, another embodiment of the article handling belt is illustrated in which an elongated belt of indeterminate length 45 includes a plurality of tubular elongated sleeves 46 which are connected together in generally parallel relationship with each other. As shown best in FIG. 12, each of the sleeves 46 has an annular groove 47 adjacent one end for engaging upper and lower cam rails 38 and 39 shown in FIG. 1. A pair of spaced relatively shallow web-engaging annular grooves 48 and 49 having wide flat bottom surfaces are provided on each of the sleeves. One of such web-engaging grooves is located at the end remote from the cam-engaging groove 47 and a second web-receiving annular groove 49 is located adjacent to and inwardly of the cam-engaging grooves.

Figure 8:
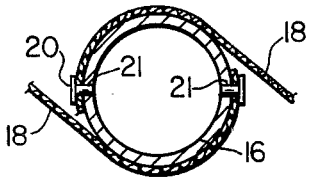
FIG. 8 is a section along the line 8—8 of FIG. 7.
Figure 12:
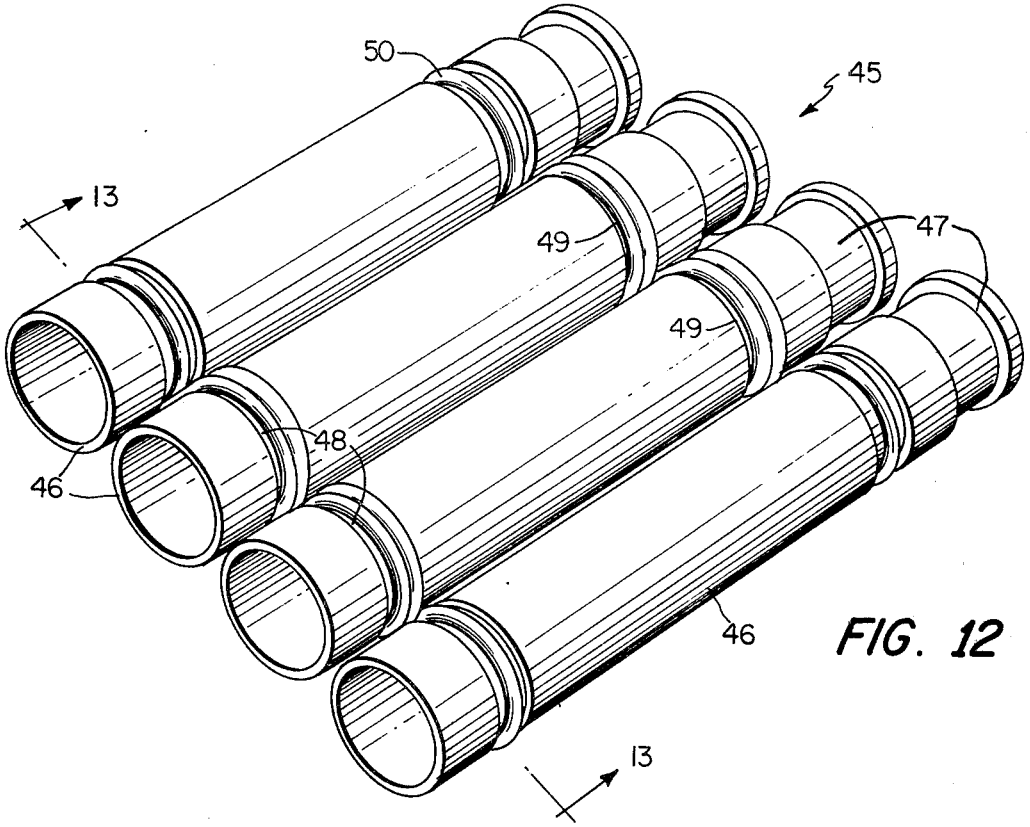
FIG. 12 is a perspective view of another embodiment of the article handling belt.
Figure 13:
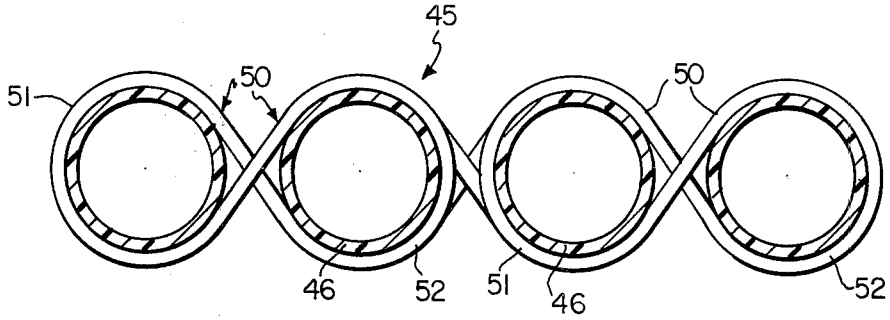
FIG. 13 is an enlarged sectional view along the line 13—13 of FIG. 12.
Figure 14:
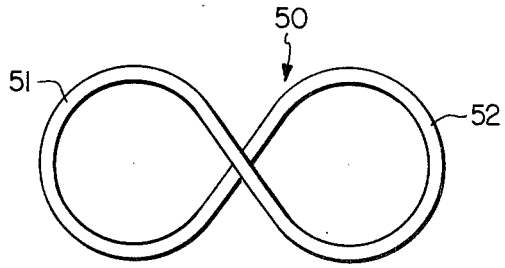
FIG. 14 is a top plan view of a connecting web loop which has been twisted into a figure 8 configuration.

With particular reference to FIGS. 12–14, in order to connect the sleeves together in spaced generally parallel relationship, a plurality of connecting webs 50 are provided and each of such webs includes a substantially continuous loop which is twisted to form a figure 8 configuration. The web 50 may be constructed of any desired flexible material such as a cord having a circular cross-section, as illustrated, or a strap having a thin rectangular cross-section, and such web includes a first loop 51 at one side and a second loop 52 at the opposite side. Each of the loops has an internal diameter substantially equal to the diameter of the flat surface of the web-receiving grooves 48 and 49. With this construction, the loop 51 may be easily applied to the first sleeve and thereafter an adjacent sleeve may be forced through the loop 52 until the second loop is received within the corresponding web-receiving groove of the adjacent sleeve. When the second loop 52 is received within the web-receiving groove, the two sleeves are held in slightly spaced generally parallel relationship with each other. Also due to the size of the loops 51 and 52, the sleeves are resisted from accidentally moving lengthwise which would permit the webs to be removed from the grooves. However, since the sleeves are not physically connected to the webs, each of such sleeves may be independently rotated about the longitudinal axis while remaining in the loops.

With reference to FIG. 15, a connecting web 55 is provided which includes a cord having a generally circular cross-section or a strap having a generally rectangular cross-section and being of predetermined length. Each of the opposite ends of the web material is bent back toward the central or bight portion and is adjustably connected thereto by a noose 56. The connecting of the ends of the web material to the central portion creates a pair of loops 57 and 58 of a size to be positioned within the web-receiving grooves 48 and 49 of contiguous sleeves.

FIG. 16 discloses a connecting web 60 in which a pair of closed loops 61 and 62 are provided with each having an inner diameter which is substantially the same as the outer diameter of the sleeves 46. A connecting member or bridge 63 is located between the loops 61 and 62 and a noose 64 is provided at each end thereof for slidably receiving the loops 61 and 62. In this modification the length of the bridge 63 substantially determines the spacing or distance "A" between the longitudinal axes of adjacent sleeves.

FIG. 17 discloses a connecting web 65 wherein a pair of closed loops 66 and 67 are integrally connected together by a bridge 68. The inner diameter of the loops is substantially the same as the outer diameter of the sleeves 46 so that the sleeves must be forced through the loops but when the loops are received within the annular web-receiving grooves, each of the sleeves may be rotated about its longitudinal axis.

With reference to FIGS. 18 and 19, a connecting web 70 is provided which is constructed of flat strap or tape type flexible material. As illustrated best in FIG. 19, the strap or tape material is cut at a predetermined length after which such material is twisted twice and the ends are joined together to define a double twist or double mobius closed circle. Thereafter, the circle is twisted to form a pair of loops 71 and 72 of a size to receive a pair of adjacent sleeves. Due to the double twist, the strap or tape loops 71 and 72 are substantially flat in the area of engagement with the sleeves and the twists occur in the area between such sleeves so that the wide portions of the strap are generally parallel with each other in the area where they cross. This construction not only substantially reduces friction which would be caused by the edges of the strap rubbing together if the twists were not provided, but also permits the loops 71 and 72 to remain substantially in longitudinal alignment with each other in use even though the width is substantially greater than the thickness.

I claim:

1. An article handling belt of indeterminate length which is movable along a predetermined path comprising a plurality of elongated hollow generally cylindrical sleeves, each of said sleeves having a longitudinal axis disposed generally normal to said path of movement of said belt, the longitudinal axes of said sleeves being in generally parallel relationship with each other and spaced apart a distance greater than the diameter of said sleeves, each of said sleeves having at least two annular web-receiving means in spaced relationship to each other along the length of the sleeve, a plurality of flexible endless webs connecting each of said sleeves to at least one adjacent sleeve, each of said webs having a pair of loops of a size to be received by the web-receiving means of adjacent sleeves, means for moving said belt along said path of movement, and means for moving said sleeves axially relative to each other while travelling along said path of movement and while the axes of said sleeves remain generally parallel with each other.

2. The structure of claim 1 including an elongated article carried by each sleeve, a portion of each article extending outwardly from one end of said sleeve, and means for selectively engaging said portion of said article.

3. The structure of claim 2 in which said elongated articles comprise ammunition cartridges, and said outwardly extending portion includes an annular extraction groove.

4. The structure of claim 3 including guide means engaging said extraction groove for moving said cartridges along a path of movement when said sleeves are moved axially relative to each other along a different path of movement so that said sleeves are moved away from said cartridges.

* * * * *